United States Patent [19]

Adams

[11] 4,448,281

[45] May 15, 1984

[54] FIRE ESCAPE DEVICE

[76] Inventor: Jack B. Adams, Rte. 7, Box 68, Griffin, Ga. 30223

[21] Appl. No.: 348,004

[22] Filed: Feb. 11, 1982

[51] Int. Cl.[3] ..... A62B 1/14

[52] U.S. Cl. ..... 182/5; 182/193; 188/65.2

[58] Field of Search ..... 182/5, 6, 7, 8, 10, 182/11, 193, 192, 191; 16/386, 270, 262; 188/65.1, 65.2

[56] References Cited

U.S. PATENT DOCUMENTS 4,056,166 11/1977 Rabelos ..... 182/5

FOREIGN PATENT DOCUMENTS 1421330 1/1976 United Kingdom ..... 16/386

*Primary Examiner*—R. P. Machado
*Assistant Examiner*—Alvin Chin-Shue
*Attorney, Agent, or Firm*—Harvey B. Jacobson

[57] ABSTRACT

A fire escape device in the form of an elongated flexible member adapted to be mounted at its upper end to a building structure, or the like and a slide mounted on the flexible member having a sling attached thereto by which a person occupying the building may safely lower himself along the exterior surface of the building in the event of a fire or other emergency situation with the length of the flexible member being sufficient to enable such a person to reach ground level or some other lower level by which the person may safely escape. The slide includes a pair of hingedly attached plate members having a unique hinge connection with a loop on one end thereof to which the sling is connected and an adjustable screw threaded member interconnecting the opposite side edges of the plate members to enable variation in the frictional gripping engagement between the plate members and the flexible member, thereby enabling a person to vary their rate of descent along the flexible member.

1 Claim, 4 Drawing Figures

FIRE ESCAPE DEVICE

BACKGROUND OF THE INVENTION

1. Field of the Invention

The present invention generally relates to a fire escape device and more particularly an elongated flexible member having a slide detachably mounted thereon with the slide including a sling or saddle connected thereto, so that a person may connect one end of the flexible member to a building structure at an elevated level and slide downwardly along the flexible member with the rate of descent being controlled by an adjustable friction producing arrangement incorporated into the slide.

2. Description of the Prior Art

A continuing problem exists of occupants of multistory buildings being injured or killed due to fire located in such a manner that the occupants cannot gain access to normal escape routes. The following U.S. patents are exemplary of devices by which occupants of such buildings can escape.

U.S. Pat. Nos. 3,294,196—Dec. 27, 1966—Rabelos 3,765,507—Oct. 16, 1973—Rabelos 4,056,166—Nov. 1, 1977—Rabelos 4,184,567—Jan. 22, 1980—Rabelos.

While such devices have performed satisfactorily, it is still desirable to provide a slide arrangement which can be easily attached to a flexible manner to enable multiple occupants to use the same flexible member and provide an accurate and positive control for the rate of descent along the flexible member.

SUMMARY OF THE INVENTION

An object of the present invention is to provide a fire escape device which includes an elongated flexible member and a slide and sling assembly mounted thereon for longitudinal sliding movement, with the slide being attachable and detachable in relation to the flexible member and including a manually adjustable structure to vary the frictional engagement between the slide and flexible member in order to accurately and effectively control the rate of descent of a person supported by the sling.

Another object of the invention is to provide a fire escape device in accordance with the preceding object in which the slide includes a pair of plate members of generally rectangular configuration having a unique hinge structure interconnecting adjacent side edges thereof with the hinge structure including an arrangement for attachment of the sling, with the opposite side edges of the plates being provided with a screw threaded structure interconnecting the side edges of the plate members to move them into variable frictional engagement with the flexible member received in partial grooves in the facing surfaces of the plate members.

A further object of the invention is to provide a fire escape device in accordance with the preceding objects in which the structure interconnecting the edges of the plate members opposite to the hinge structure includes a pivotal threaded member connected to the edge portion of one plate member and a screw threaded wing nut of enlarged configuration engaging the outer surface of the other plate member adjacent the side edge thereof to enable easy and accurate adjustable control of the frictional engagement between the plate members and flexible member.

Still another object of the invention is to provide a fire escape device in accordance with the preceding objects in which the hinge structure interconnecting the side edges of the plate members includes a pair of parallel rods interconnected by a generally circular loop at the lower end thereof which receives the sling structure with the ends of the rods being interconnected by short plate elements, so that the adjacent side edges of the plate members are retained in assembled relation.

Yet another important object of the present invention is to provide a fire escape device which is safe in operation, dependable and effective for enabling occupants of high rise buildings to escape a fire.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
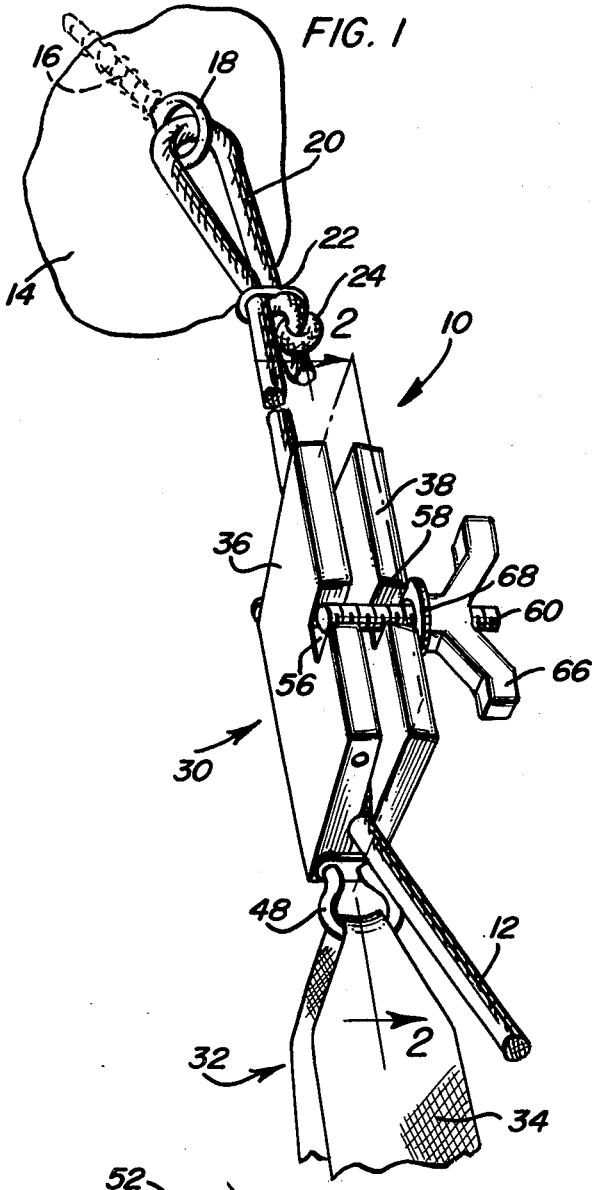
FIG. 1 is perspective view of the fire escape device of the present invention illustrating the relationship of the flexible member, slide, sling and anchor device for the upper end of the flexible member.
Figure 2:
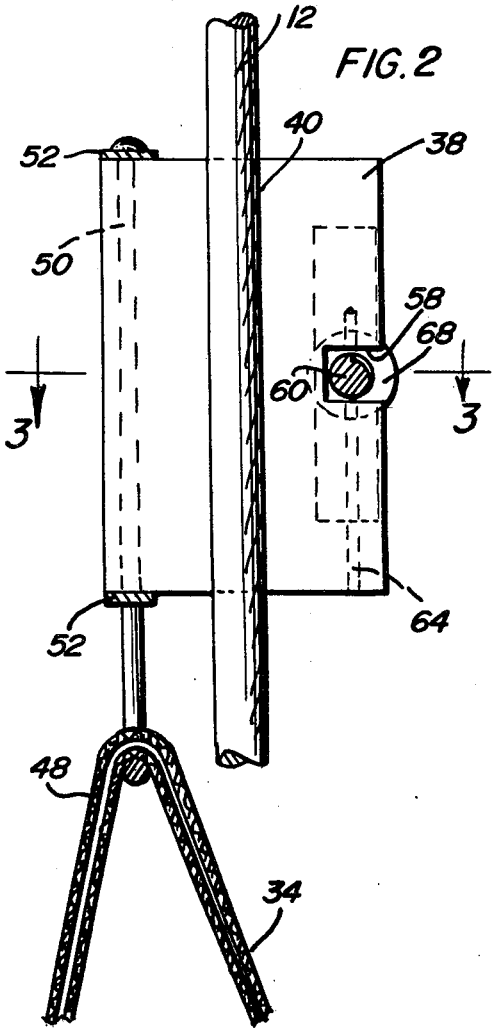
FIG. 2 is a vertical sectional view, taken substantially upon a plane passing along section line 2—2 of FIG. 1, illustrating the interior construction of one of the plate members of the slide.
Figure 4:
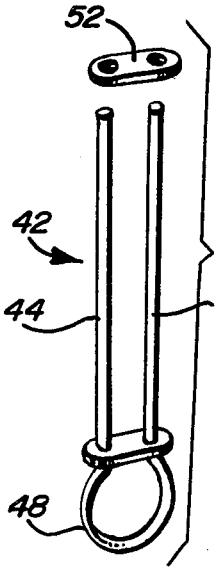
FIG. 4 is an exploded perspective view of the hinge structure for interconnecting the members.
Figure 3:
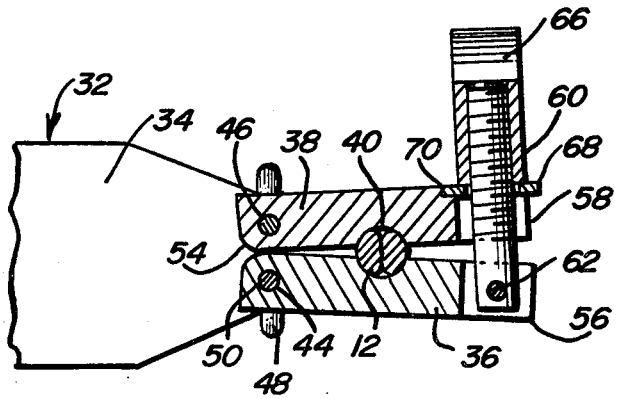
FIG. 3 is a transverse, sectional view, taken substantially upon a plane passing along section line 3—3 of FIG. 2, illustrating further structural details of the slide.

The fire escape device of the present invention is generally designated by the reference numeral 10 and includes an elongated flexible member 12 which may be in the form of a flexible rope of natural or synthetic fiber material formed in a conventional manner, with the upper end thereof being anchored to a building structure 14 by a suitable anchor bolt 16 having an eye 18 thereon through which the upper end of the flexible member is inserted to form a loop 20 with an oval-shaped link 22, or the like, being provided thereon with the free end of the flexible member being formed into a knot 24 thereby enabling the flexible member 12 to be anchored to the building structure 14. It is pointed out that other types of anchoring structures may be employed or the upper end of the flexible member 12 may be tied to a stationary building component, article of furniture, or the like, capable of positively supporting the weight of a person or several persons which may be supported by the flexible member 12.

The fire escape device 10 also includes an attachable and detachable slide 30 including a sling 32 attached thereto in which the sling may be in the form of a belt 34 of web construction having suitable buckle structure, or the like, or of endless construction, so that the sling may extend under the arm portions of a person using the device or otherwise effectively support the torso area of such a person. The sling may be in the form of a harness or a simple belt-like structure with it being capable of effectively and safely supporting a person using the fire escape device.

The slide 30 includes a pair of generally rectangular plate members 36 and 38 which have substantially planar inner and outer surfaces with the inner surface of each plate member 36 and 38 including a longitudinal groove 40 which has a transverse dimension less than the radius of the flexible member 12 so that the surfaces of the grooves 40 will engage the flexible member 12 before the inner surfaces of the plate members 36 and 38 contact each other, thereby frictionally gripping the flexible member 12 in a manner defined more fully hereinafter.

The plate members 36 and 38 are disposed in side-by-side relation with one pair of adjacent side edges being hingedly interconnected by a hinge structure generally designated by numeral 42 and which includes a pair of generally parallel rods 44 and 46 having one end thereof interconnected by a generally circular loop 48 which forms a continuation of the parallel rods 44 and 46 with the loop 48 being capable of receiving the belt 34 therethrough as illustrated in FIG. 1, with the side edges of the flexible belt being folded inwardly, thus permanently securing the belt 34 which forms a sling 32 to the slide 30. The parallel rods 44 and 46 are received in passageways 50 extending through the side edge portions of the plate members 36 and 38 and small links or plate elements 52 interconnect the rod members 44 and 46 at the upper and lower ends thereof to maintain the rod members 44 and 46 in parallel relation and the upper ends of the rods 44 and 46 where they extend through the plate element 52 are deformed or enlarged in a conventional manner, thereby permanently securing the hinge structure 42 to the plate members 36 and 38 and thereby hingedly connecting the plate members together for movement about parallel axes defined by the rods 44 and 46. In order to facilitate pivotable movement of the plate members 36 and 38, the facing corners thereof may be arcuately curved as at 54 so that the plate members 36 and 38 may be pivoted apart sufficient to enable the flexible member 12 to be inserted between the opposite side edges of the plate members 36 and 38 in order to move the flexible member 12 into registry with the grooves 40.

The opposite side edges of the plates 36 and 38 are provided with rectangular notches 56 and 58 which are in alignment with each other with the notch 56 receiving an end of a screw threaded bolt 60 therein and the bolt 60 is pivotally attached to the plate 36 by a hinge pin 62 extending longitudinally from one end of the plate 36 with the hinge pin 62 being received in a passageway 64 which bridges the notch 56, thus securely but pivotally anchoring the end of the bolt 60 to the plate 36. The screw threaded end of the bolt 60 extends through the notch 58 when in operative position and includes an enlarged wing nut 66 thereon of generally Y-shaped configuration with the inner end of the nut 66 including a flange in the form of a washer 68, or the like, which engages a correspondingly shaped recess 70 in the outer surface of the plate 38. The washer or flange 68 may be integral with or separate from the wing nut 66. This structure enables the bolt and wing nut assembly to be pivoted to a position disengaged from the plate 38 so that the plates 36 and 38 may move apart in order to assembly the slide 30 onto the flexible member 12. After the flexible member 12 has entered the grooves 40, the plates 36 and 38 are pivoted toward each other and the bolt 60 pivoted so that the washer or flange 68 and nut 66 engage the outer surface of the plate 38 after which rotation of the nut 66 will vary the frictional engagement between the plates 36 and 38 and the flexible member 12, thereby enabling a person to easily and accurately control his rate of descent along the flexible member 12.

The construction of the flexible member 12 and the attachable and detachable slide 30 and the sling 32 is such that it may be easily connected to a building structure with the rope and other components being varied in number depending upon the number of building occupants involved. The occupants of a building may quickly and easily descend along the rope, thus safely escaping from a fire and eliminating the necessity of having extremely long ladder structures or other facilities to enable persons to escape from a high rise building when their normal escape route has been cut off due to the location of the fire in the building.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a fire escape device having an elongated flexible member provided with an upper end capable of being anchored with respect to a building structure and having a length to depend to ground level or other safe level, that improvement comprising a slide and sling assembly in which the sling is connected to the slide and adapted to supportingly engage a person descending along the flexible member, said slide comprising a pair of generally rectangular plate members having inwardly facing and aligned grooves adapted to receive the flexible member and frictionally engage the flexible member, parallel hinge rods interconnecting adjacent side edges of the plate members, means connecting the hinge rods and sling and means adjustably interconnecting the opposite side edges of the plate members to vary the frictional gripping engagement of the plate members with the flexible member, said hinge rods being interconnected at their lower ends by a loop structure that is continuous with the rods, means anchoring the rods within longitudinal passages through the side edge portions of the plate members, thereby connecting the plate members for hinged movement, said loop structure forming said means connecting the hinge rods and sling, said means connecting the opposite side edges of the plate members including a notch in each of the plate members, a threaded bolt having one end pivotally mounted in the notch in one plate member and removably received in the notch in the side edge of the other plate member, an enlarged wing nut structure mounted on the bolt for engaging the outer surface of the plate member opposite to that having the bolt mounted therein for varying the frictional engagement between the plate members and flexible member, each of said plate members having substantially straight edges from end to end of each edge to render the plate members more rigid and less prone to flexing, said loop structure being disposed at the lower end of the slide and having a major internal diameter greater than the distance between the hinge rods to provide an enlarged loop receiving the sling, said means anchoring the hinge rods in the longitudinal passages through the plate members including a plate positioned on the hinge rods at the juncture with the loop structure in engagement with the lower edges of the plate members and an anchoring plate positioned over the upper ends of the rods in engagement with the upper edges of the plate members with the upper ends of the rods above the anchor plate being enlarged to retain the anchor plate on the hinge rods and retain the hinge rods in the longitudinal passages, the grooves receiving the flexible member being generally parallel to the hinge rods and intermediate the hinge rods and threaded bolt so that the sling engaged with the loop structure will not become entangled with the flexible member when the slide is moving along the flexible member.

* * * * *